US008950388B2

(12) United States Patent
McPherson

(10) Patent No.: US 8,950,388 B2
(45) Date of Patent: Feb. 10, 2015

(54) SWIVEL CABLE GUARD

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 13/841,811

(22) Filed: Mar. 15, 2013

(65) Prior Publication Data

US 2014/0261359 A1 Sep. 18, 2014

(51) Int. Cl.

| | |
|---|---|
| ***F41B 5/10*** | (2006.01) |
| ***F41B 5/14*** | (2006.01) |
| ***F41B 5/20*** | (2006.01) |

(52) U.S. Cl.

CPC ..... *F41B 5/1403* (2013.01); *F41B 5/10* (2013.01); *F41B 5/1426* (2013.01); *F41B 5/14* (2013.01)

USPC ..... 124/88; 124/25.6; 124/86; 124/89

(58) Field of Classification Search

CPC ..... F41B 5/10; F41B 5/14; F41B 5/1426

USPC ..... 124/25.6, 86, 88, 89

See application file for complete search history.

(56) References Cited

U.S. PATENT DOCUMENTS

| | | | | |
|---|---|---|---|---|
| 4,061,125 | A | 12/1977 | Trotter | |
| 4,203,412 | A * | 5/1980 | Rickard | 124/25.6 |
| 4,207,858 | A * | 6/1980 | Blackstone | 124/25.6 |
| 4,377,152 | A * | 3/1983 | Saunders | 124/88 |
| 4,452,222 | A * | 6/1984 | Quartino et al. | 124/23.1 |
| 4,461,267 | A * | 7/1984 | Simonds et al. | 124/25.6 |
| 4,542,591 | A | 9/1985 | Montgomery | |
| 4,542,732 | A * | 9/1985 | Troncoso | 124/25.6 |
| 4,596,228 | A * | 6/1986 | Smith | 124/25.6 |
| 4,628,892 | A | 12/1986 | Windedaul et al. | |
| 4,819,611 | A | 4/1989 | Sappington | |
| 4,834,061 | A * | 5/1989 | Chattin | 124/86 |
| 4,886,038 | A * | 12/1989 | Betters | 124/25.6 |
| 4,903,678 | A * | 2/1990 | Walker | 124/90 |
| 4,917,070 | A * | 4/1990 | Townsend | 124/23.1 |
| 4,919,108 | A * | 4/1990 | Larson | 124/88 |
| 5,002,035 | A | 3/1991 | Brooks | |
| 5,103,798 | A | 4/1992 | McGraw et al. | |
| 5,161,514 | A * | 11/1992 | Cary | 124/24.1 |
| 5,178,122 | A | 1/1993 | Simonds | |

(Continued)

OTHER PUBLICATIONS

U.S. Appl. No. 12/569,738, filed Sep. 29, 2009.

(Continued)

*Primary Examiner* — Gene Kim
*Assistant Examiner* — Alexander Niconovich
(74) *Attorney, Agent, or Firm* — Vidas, Arrett & Steinkraus

(57) ABSTRACT

A cable guard for a compound archery bow includes a body and a cable retaining member connected to the body by a joint. The cable retaining member may retain at least one cable of an archery bow. The body of the cable guard has a length sufficient to position the joint at least at the drawn position of at least one of the cables retained by the cable retaining member. The joint connecting the cable retaining member to the body of the cable guard permits the opening of the cable retaining member to swivel forwards towards the mounting portion. Swiveling forward, the opening of the cable retaining members brings at least one of the retained cables closer to the bowstring plane of travel of the bow to which it is mounted.

19 Claims, 6 Drawing Sheets

(56) References Cited

U.S. PATENT DOCUMENTS

| | | | | | |
|---|---|---|---|---|---|
| 5,323,756 | A | | 6/1994 | Rabska | |
| 5,368,006 | A | * | 11/1994 | McPherson | 124/25.6 |
| 5,392,757 | A | * | 2/1995 | Head et al. | 124/86 |
| 5,415,149 | A | * | 5/1995 | Derus et al. | 124/23.1 |
| 5,433,792 | A | * | 7/1995 | Darlington | 124/25.6 |
| 5,553,597 | A | * | 9/1996 | Sparks | 124/44.5 |
| 5,553,600 | A | * | 9/1996 | Miller | 124/86 |
| 5,555,874 | A | * | 9/1996 | Savage | 124/1 |
| 5,651,355 | A | * | 7/1997 | Gallops, Jr. | 124/25.6 |
| 5,718,213 | A | * | 2/1998 | Gallops et al. | 124/25.6 |
| 5,720,269 | A | * | 2/1998 | Saunders | 124/86 |
| 5,722,385 | A | * | 3/1998 | Bunk | 124/86 |
| 5,791,324 | A | | 8/1998 | Johnson | |
| D412,021 | S | | 7/1999 | Gray | |
| 5,983,880 | A | * | 11/1999 | Saunders | 124/25.6 |
| 6,098,607 | A | | 8/2000 | Strother | |
| 6,152,124 | A | * | 11/2000 | Gallops, Jr. | 124/25.6 |
| 6,178,958 | B1 | * | 1/2001 | Gallops, Jr. | 124/25.6 |
| 6,382,201 | B1 | * | 5/2002 | McPherson et al. | 124/89 |
| 6,425,385 | B1 | * | 7/2002 | Gallops, Jr. | 124/25.6 |
| 6,443,139 | B1 | | 9/2002 | McPherson | |
| 6,550,467 | B2 | * | 4/2003 | Gallops, Jr. | 124/25.6 |
| 6,634,348 | B2 | * | 10/2003 | Gallops, Jr. | 124/25.6 |
| 6,655,371 | B2 | * | 12/2003 | Gallops, Jr. | 124/25.6 |
| 6,681,753 | B2 | * | 1/2004 | Afshari | 124/44.5 |
| 6,681,754 | B1 | * | 1/2004 | Angeloni | 124/44.5 |
| 6,708,684 | B2 | * | 3/2004 | Chattin | 124/25.6 |
| 6,715,479 | B1 | * | 4/2004 | Bunk | 124/25.6 |
| 6,722,354 | B1 | * | 4/2004 | Land | 124/25.6 |
| 6,745,756 | B1 | * | 6/2004 | Achkar | 124/88 |
| 6,889,679 | B2 | * | 5/2005 | Chattin | 124/25.6 |
| 6,904,900 | B2 | * | 6/2005 | Gallops, Jr. | 124/25.6 |
| 6,966,314 | B2 | * | 11/2005 | McPherson | 124/89 |
| 7,100,591 | B2 | * | 9/2006 | Terry | 124/44.5 |
| 8,028,685 | B2 | * | 10/2011 | Clark | 124/25.6 |
| 8,176,906 | B2 | * | 5/2012 | Simo et al. | 124/25.6 |
| 8,307,816 | B2 | * | 11/2012 | Darlington | 124/88 |
| 8,371,283 | B2 | * | 2/2013 | Grace et al. | 124/88 |
| 8,402,960 | B2 | * | 3/2013 | McPherson | 124/88 |
| 8,424,511 | B2 | * | 4/2013 | Grace et al. | 124/88 |
| 8,485,169 | B2 | * | 7/2013 | Dahl, II | 124/25.6 |
| 8,616,189 | B2 | * | 12/2013 | McPherson et al. | 124/88 |
| 2003/0136392 | A1 | * | 7/2003 | McPherson | 124/25.6 |
| 2008/0127961 | A1 | | 6/2008 | McPherson | |
| 2010/0101549 | A1 | * | 4/2010 | Grace et al. | 124/25.6 |
| 2010/0132685 | A1 | * | 6/2010 | De Sousa | 124/88 |
| 2010/0224178 | A1 | * | 9/2010 | McPherson | 124/25.6 |
| 2010/0282226 | A1 | * | 11/2010 | Marzullo | 124/25.6 |
| 2010/0319670 | A1 | * | 12/2010 | Sims et al. | 124/89 |
| 2011/0011385 | A1 | * | 1/2011 | Grace et al. | 124/25.6 |
| 2011/0073090 | A1 | * | 3/2011 | McPherson | 124/25.6 |
| 2011/0192385 | A1 | * | 8/2011 | Clark | 124/25.6 |
| 2011/0247602 | A1 | * | 10/2011 | McPherson | 124/25.6 |
| 2012/0042861 | A1 | * | 2/2012 | Anselmo | 124/25.6 |
| 2012/0042864 | A1 | * | 2/2012 | McPherson | 124/88 |
| 2012/0204851 | A1 | * | 8/2012 | McPherson et al. | 124/25.6 |
| 2012/0272939 | A1 | * | 11/2012 | Grace et al. | 124/25.6 |

OTHER PUBLICATIONS

U.S. Appl. No. 61/101,562, filed Sep. 30, 2008.

Bowtech Archery Website; Accessed on Jun. 7, 2012; http://www.bowtecharchery.com/#/technologyBreakdown?r=products_technology&i=6.

* cited by examiner

SWIVEL CABLE GUARD

BACKGROUND OF THE INVENTION

This invention relates to compound bows, and more specifically to cable guards used with compound bows. Compound bows are well known in the field of archery, an activity that involves skill, accuracy, and precision. When a drawn arrow is released, it is desirable to minimize vertical travel and/or horizontal travel of the rear of the arrow shaft, in order to achieve a consistent and accurate arrow launch.

Compound bows typically have a rotatable member at each end of the bow—of which at least one is typically a cam assembly. A first cable (e.g. a bow string) is in communication with the rotatable members and a second cable (e.g. a power cable) is in communication with the cam assembly. Some compound bows include an anchor cable, such as a one-cam bow, or multiple power cables, such as a two-cam bow.

Fixed, relatively stiff cable guards have previously been used to displace the power cable(s) and/or the secondary string payout cable laterally, moving them out of the shooting plane proximate to the arrow's travel path during release of a drawn arrow. Such cable guards also prevent the arrow from contacting the displaced cable(s) during draw and release. However, the lateral displacement of the power cable(s) and/or secondary string payout cable generally applies a lateral force to the rotatable members, and to the distal ends of the bow's limbs, which can result in undesirable nock travel in the horizontal direction during arrow launch. With modern compound bows having a shorter axle-to-axle distance between the rotatable members than prior bow designs, the negative effects of traditional cable guards have been amplified.

There remains a need for novel cable guard configurations that allow for greater bow efficiency and reduced torqueing forces on the limbs and/or rotatable members.

All US patents and applications and all other published documents mentioned anywhere in this application are incorporated herein by reference in their entirety.

Without limiting the scope of the invention, a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is also provided for the purposes of complying with 37 C.F.R. 1.72. The abstract is not intended to be used for interpreting the scope of the claims.

BRIEF SUMMARY OF THE INVENTION

Embodiments of the invention may include a cable guard for a compound archery bow. A compound archery bow may contain a riser supporting a first limb and a second limb opposite the first limb. The first and second limbs of the bow may each support a rotatable member. Drawing a bowstring that extends between the rotatable members may cause a cable extending from one of the rotatable members or limbs to the opposite rotatable member or limb, to flex the limbs of the compound bow.

The cable guard may comprise a body and a cable retaining member connected to the body by a joint. The cable retaining member may retain a control cable, power cable and/or other harness cable of the compound archery bow. The retained cables may have a brace position when the bow is at rest. When the bowstring of the bow is drawn, the retained cables may move to a drawn position as the bow's limbs are flexed. The joint connecting the cable retaining member to the body of the cable guard may be located traverse to the drawn position of the retained cable, such that the retained cable does not pass or intersect a plane defined by the joint when the bow is drawn. In some embodiments, the retained cable may move closer to the bow's riser when the bow is drawn. In other embodiments, the retained cable may move away from the bow's riser when the bow is drawn. In such embodiments, the joint connecting the cable retaining member to the body of the cable guard is located transverse to the drawn position of the retained cable, and may be positioned rearwardly relative to the drawn position of the retained cable and the riser of the bow.

In some embodiments, when in the brace position, the retained cable may be deflected away from the riser by the cable retaining member. Desirably, the retained cable is deflected laterally away from a plane defined by the bowstring travel following release (e.g. arrow shooting plane), where the retained cable is deflected in a lateral direction by the cable retaining member. The joint connecting the cable retaining member to the body of the cable guard permits the cable retaining member to swivel or open towards the plane of bowstring travel when the retained cables move towards the drawn position. Swiveling or opening of the cable retaining member about the joint relative to the cable guard body, towards the plane of bowstring travel permits movement of the retained cables closer to the bowstring plane of travel. This in turn reduces the forces exerted on the bow's limbs by the cables, thereby permitting a truer trajectory for an arrow released from the bow.

In some embodiments, the retained harness cable(s) may bias the cable retaining member about the joint towards the riser and traverse to the bowstring plane of travel in its brace position. Additionally the cable may bias the cable retaining member about the joint towards the bowstring plane of travel in its drawn position. Being both biased towards the riser and traverse to the bowstring plane of travel as well as toward the bowstring plane of travel of the bow, the cable retaining member may move towards the plane of the arrow during draw, and move away from the flight path of an arrow upon release of an arrow from the bow, as the cable re-assumes its brace position.

In some embodiments, a compound bow comprises a riser, a bowstring, a cable and a cable guard. The cable guard comprises a body, a cable retaining member and a joint connecting the cable retaining member to the body. The joint defines a pivot axis and the cable retaining member is pivotable with respect to the body about the pivot axis. A position of the pivot axis is fixed with respect to the riser and located rearward of the cable. The pivot axis is parallel to a bowstring plane of travel.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying description, in which there are illustrated and described various embodiments of the invention.

BRIEF DESCRIPTION OF THE DRAWINGS

A detailed description of the various embodiments of the invention is hereafter provided which makes specific reference to the following figures.

DETAILED DESCRIPTION OF THE INVENTION

Figure 1:
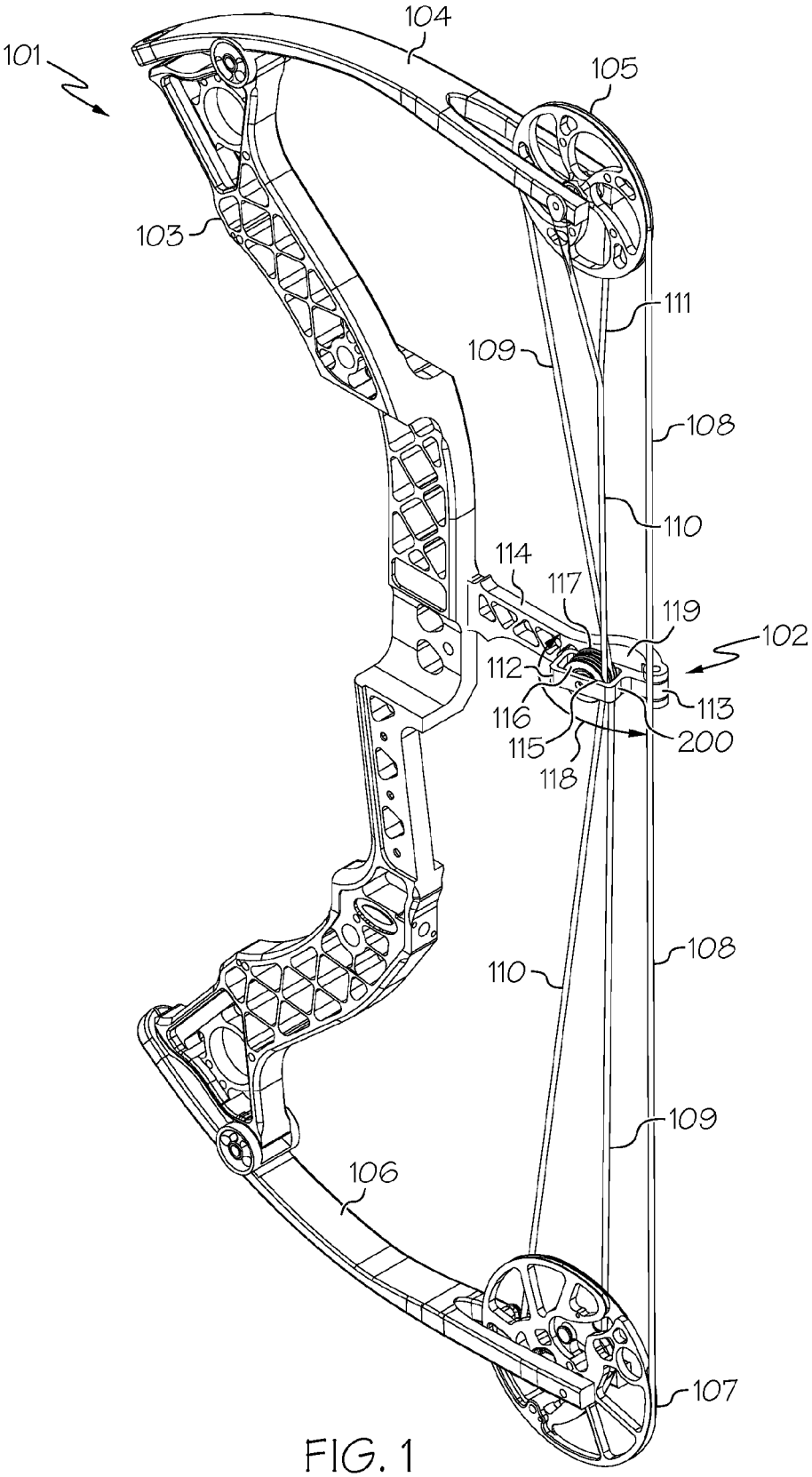
FIG. 1 depicts an isometric view of one embodiment of a compound archery bow including a cable guard with a joint.

While the invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features, unless otherwise indicated.

As shown in FIG. 1, in at least one embodiment a compound archery bow 101 may include a cable guard 102. Archery bow 101 generally includes a riser 103. Attached to an end of the riser 103 is a first limb 104. First limb 104 supports a first rotatable member 105 containing a first bowstring track. Attached to the opposite end of riser 103 is a second limb 106. Second limb 106 supports a second rotatable member 107 comprising a second bowstring track and a cam assembly.

A bowstring 108 extends between the first bowstring track of the first rotatable member 105 and the bowstring track of the second rotatable member 107. As shown in FIG. 1, bowstring 108 wraps around first rotatable member 105 to form control cable 109 portion extending from first rotatable member 105 to second rotatable member 107. Accordingly, FIG. 1 depicts an embodiment of a single cam bow. In other embodiments, such as, but not limited to, 1.5 cam bows, control cable 109 may be formed from a length of cable independent of bowstring 108. In other embodiments, a dual cam bow generally omits a control cable 109 but will comprise multiple power cables, as discussed below. Any embodiment of a compound bow may include the cable guard 102 as described herein.

Desirably, a power cable 110 communicates with cam assembly of the second rotatable member 107 at one end, and is anchored at its other end to opposite sides of an axle of the first rotatable member 105 via y-harness 111. In other embodiments, power cable 110 may be anchored to the first rotatable member 105, for example as described in U.S. Pat. Nos. 8,020,544 and 7,946,281, the entire disclosures of which are hereby incorporated herein by reference. Power cable 110 may, in some embodiments, be anchored directly to the first limb 104 with or without the use of a y-harness. Additionally, other embodiments, such as, but not limited to, dual cam bows, may include a second power cable.

Figure 2:
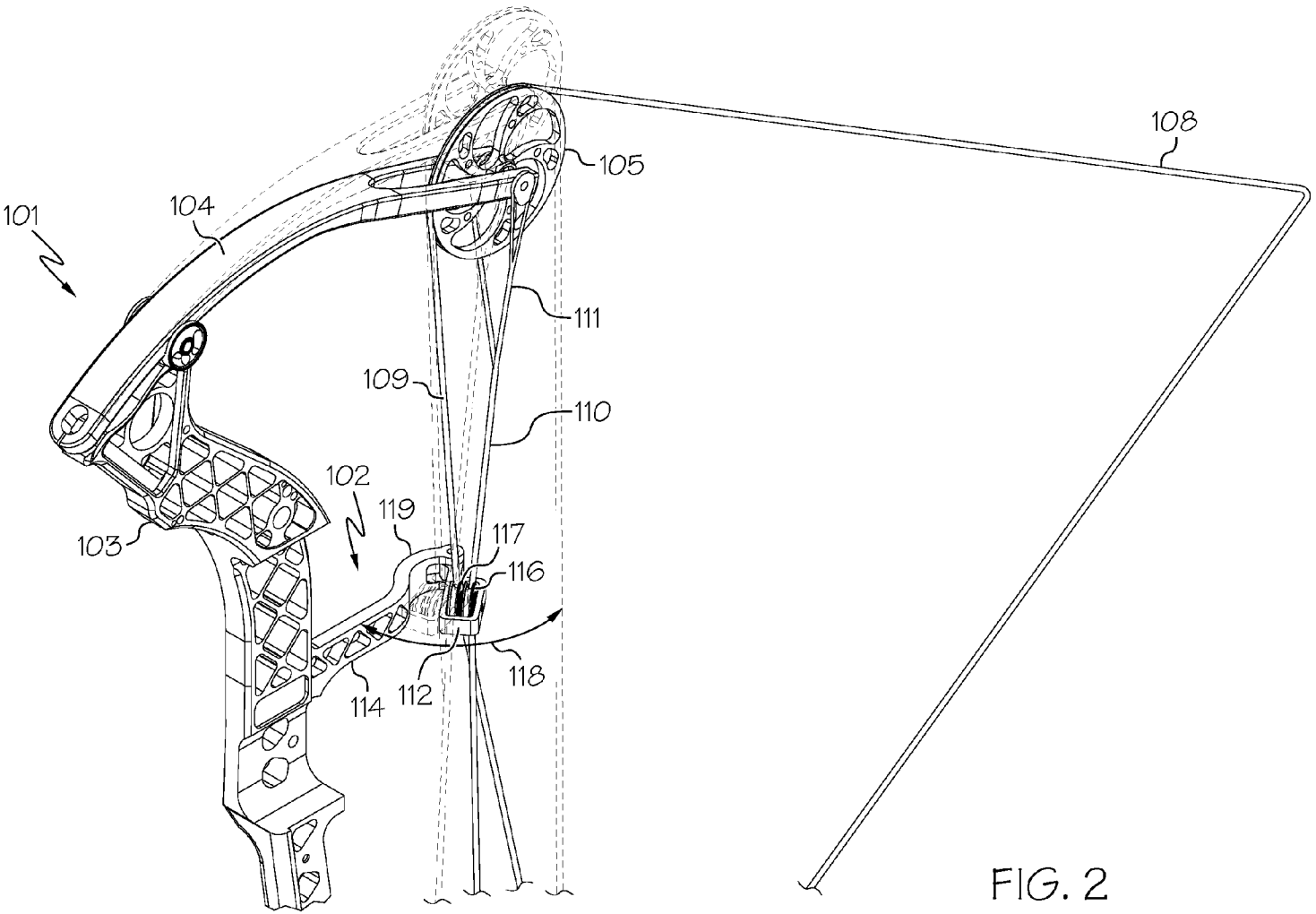
FIG. 2 depicts a detail partial isometric view of one embodiment showing in phantom line the movement of the various components of the archery bow shown in FIG. 1 when the bow is drawn.

In at least one embodiment, anchoring of power cable 110, regardless of how accomplished, permits the power cable 110 to pull the limbs 104 and 106 closer together when the bowstring 108 is drawn, as shown in FIG. 2. As limbs 104 and 106 are drawn together, the rotatable members 105 and 107 displace accordingly. At full draw of the bowstring 108, limbs 104 and 106 have been pulled inwards or towards each other by power cable 110. FIG. 2 depicts a bow in a drawn orientation. Likewise, rotatable members 105 and 107 have displaced from their brace positions (indicated by phantom lines in FIG. 2) to full drawn positions (indicated by solid lines in FIG. 2). The movement of the rotatable members 105 and 107 (including displacement and rotation) and of the limbs of 104 and 106 in turn displace the power cable 110 and control cable 109 from a brace position indicated by phantom lines to drawn positions indicated by solid lines in FIG. 2. Thus, as bowstring 108 is drawn, power cable 110 pulls limbs 104 and 107 together while displacing from a brace position (phantom lines) to a drawn position (bold lines). Similarly, control cable 109 is displaced from a brace position (phantom lines) to a drawn position (bold lines).

In some embodiments, as control cable 109 and power cable 110 move during draw, cable retaining member 112 of cable guard 102 moves about the joint 113 relative to the cable guard body 114, towards a bowstring plane of bowstring travel. This lateral movement of retaining member 112 allows the control cable 109 and power cable 110 to move closer to the bowstring travel plane, thereby reducing lateral displacement of control cable 109 and power cable 110, and reducing the lateral components of the forces applied on limbs 104 and 106. The resulting reduction in these forces reduces any potential lateral deflection of the limbs 104 and 106 and the bowstring 108 as it returns in a forward direction to its brace position after being released from full draw. Reduction of the lateral force acting on the limbs 104 and 106 helps to straighten the path of the bowstring 108 during release, which in turn, produces a more consistent and accurate arrow launch, providing a truer trajectory for an arrow shot from archery bow 101.

In at least one embodiment, joint 113 permits cable retaining member 112 to move towards the bowstring plane of travel as bowstring 108 is drawn. For example, the cable retaining member 112 can have a first orientation with respect to the rest of the cable guard in a brace condition of the bow, and the cable retaining member 112 can have a second orientation with respect to the rest of the cable guard in a drawn condition of the bow. Desirably, the cable retaining member 112 is positioned closer to the shooting plane in the second orientation than when in the first orientation, which allows the cable(s) to be closer to the shooting plane in the drawn/second orientation.

As shown in FIG. 1, joint 113 connects cable retaining member 112 to body 114 of cable guard 102. Joint 113 may take on various forms, provided it permits movement of cable retaining member 112 towards and away from the plane of bowstring travel. Additionally, joint 113 should permit cable retaining member 112 to move towards and away from riser 103 and toward and away from the body 114. Recess 119 within body 114 may be used to transversely displace the location of the joint 113, which in turn may permit the cable retaining member 112 to move closer to riser 103 and body 114. Regardless of the movement provided by joint 113, the drawn position of power cable 110 is preferably closer to the plane of the bowstring travel than the position on the power cable 110 in the brace position.

Figure 3:
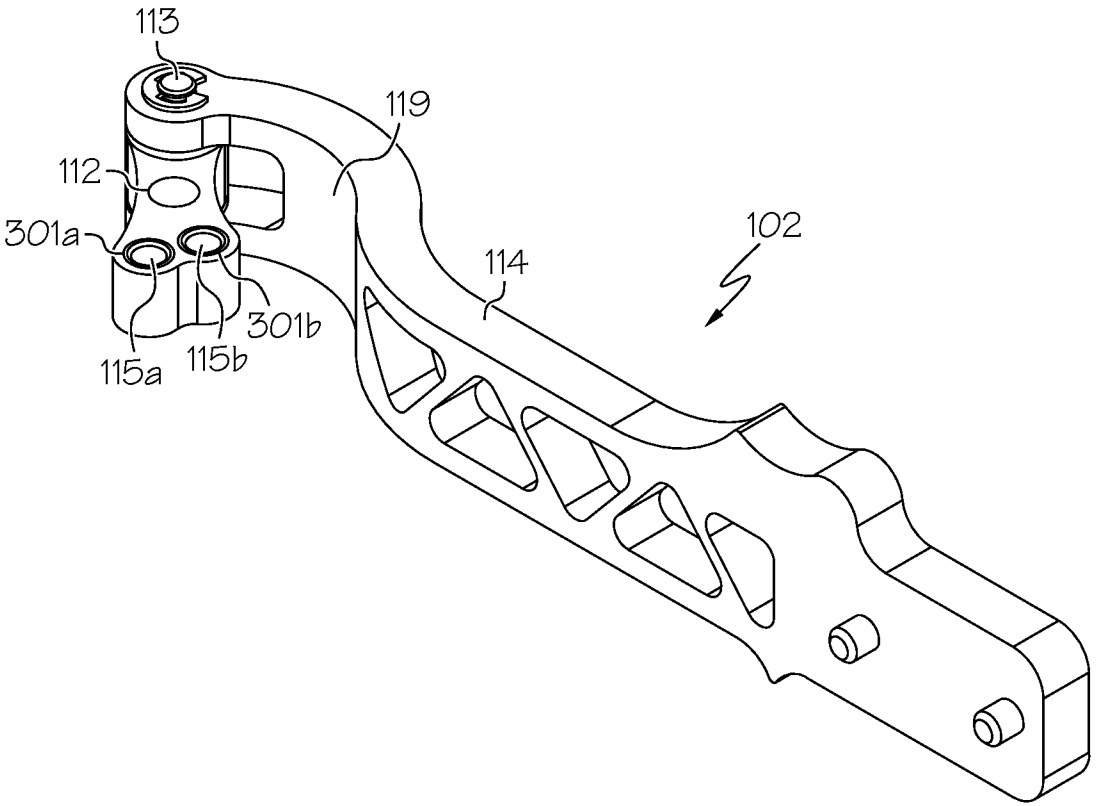
FIG. 3 depicts a detail view of one embodiment of a cable guard including a joint.

In at least one embodiment shown in FIGS. 1 and 2, cable retaining member 112 is urged towards the bowstring plane of travel by the combined action of power cable 110 and control cable 109. As can be seen in the embodiment shown in FIGS. 1 and 2, cable retaining member 112 may completely surround the power cable 110 and control cable 109 and include a space or opening 115 through which power cable 110 and control cable 109 extend. In this embodiment, the cable retaining member 112 may include one or both of a front surface or a rear surface, which may function as a safety mechanism to retain either of the power cable 110 and control cable 109 within the cable retaining member 112. In at least one embodiment the opening 115 may be defined as the area between the sheave 116 and 117 and a structural member 200 which in turn may be integral with or engaged to the cable retaining member 112. In some embodiments, structural member 200 may partially or completely surround sheaves 116 and 117. In an alternative embodiment the cable retaining member 112 is not required to enclose the sheaves 116 and 117 and the power cable 110 and control cable 109. In this embodiment the cable retaining member 112 may only include sufficient side structure to support sheaves 116 and 117, leaving one or both opposite ends open. In alternative embodiments, opposite sides of structural member 200 may include openings adapted to receive support axle 410 about which sheave 116 and 117 rotate during the draw and release of the power cable 110, control cable 109, and bowstring 108. In at least one embodiment, in combination or the alternative, openings 115*a* and 115*b* may be a closed loop as shown in FIG. 3. In other embodiments structural member 200 is not required to completely enclose opening 115. Accordingly, opening 115 may be a slot within cable retaining member 112. In some embodiments structural member 200 provides a surface against which power cable 110 and/or the control cable 109 may be biased in its brace position. In combination or the alternative, structural member 200 may provide a surface against which power cable 110 and/or the control cable 109 may be biased in its drawn position. In some embodiments, the power cable 110 and/or the control cable 109, may contact the same surface in the brace position and drawn position. In combination or the alternative, the surface against which the control cable 109 or the power cable 110 may be biased, may be provided by another structure incorporated into opening 115 or the cable retaining member 112.

In at least one embodiment as depicted in FIG. 1, power cable 110 and control cable 109 are engaged to the cable retaining member 112.

In at least one embodiment as shown in FIG. 1, sheave 116 provides a surface against which power cable 110 is biased in its brace and drawn positions. Likewise, sheave 117 provides a surface against which control cable 109 is biased in its drawn and brace positions.

When in the drawn position, power cable 110 and/or control cable 109 bias cable retaining member 112 towards the plane of bowstring travel. Additionally, control cable 109 and/or power cable 110 may bias the cable retaining member 112 towards riser 103 in the drawn and/or brace position. In the embodiment shown in FIG. 1, power cable 110 and control cable 109 bias cable retaining member 112 towards riser 103 and the plane of bowstring travel such that the net vector component of the force acting against sheave 116 and 117 is in a direction away from joint 113 when power cable 110 and control cable 109 are in the drawn position.

In one embodiment as shown in FIGS. 1 and 2, cable retaining member 112 may extend forwardly relative to a single pivot joint 113, in both the brace position and the drawn position of power cable 110 and control cable 109. Accordingly, in the embodiment shown in FIGS. 1 and 2, joint 113 only permits cable retaining member 112 to move the retained portions of power cable 110 and control cable 109 along the arc depicted at 118. Accordingly, for the retained portions of power cable 110 and control cable 109 to move towards riser 103 they must follow arc 118 in a clockwise direction upon release of a bowstring 108 from a drawn position. Following arc 118 clockwise, the retained portions of power cable 110 and control cable 109 will also move from a proximal position relative to a bowstring plane of travel at draw, transversely to a distal position relative to a bowstring plane of travel following release to a brace position. This movement occurs for the elements of the cable retaining member 112, and sheaves 116, 117.

Likewise, for the retained portions of power cable 110 and control cable 109 to move towards bowstring plane of travel from a brace position to a draw position, the cable retaining member 112 must follow arc 118 counterclockwise. Following arc 118 counterclockwise, the retained portions of power cable 110 and control cable 109 will move away from riser 103. Thus, in the embodiment shown in FIGS. 1 and 2, the retained portions of cables 110 and 109 cannot move towards the riser 103 without moving away from the bowstring plane of travel.

In the embodiment shown in FIGS. 1 and 2, in their respective brace positions power cable 110 and control cable 109 are deflected away from the riser 103 and the bowstring plane of travel by the cable retaining member 112. During draw, the tendency of power cable 110 and control cable 109 to resist deflection away from riser 103 biases cable retaining member 112 to move counter-clockwise along arc 118 towards riser 103. Likewise, as the bow returns to a brace condition, the tendency of power cable 110 and control cable 109 to resist deflection away from the bowstring plane of travel biases the cable retaining member 112 to move clockwise along arc 118 towards the bowstring plane of travel. Thus, in the embodiment shown in FIGS. 1 and 2, the retained portions of power cable 110 and control cable 109 at brace are simultaneously biased clockwise towards riser 103 and counterclockwise towards the bowstring plane of travel. As a result, the retained portions of control cable 109 and power cable 110 at brace assume an equilibrium position on arc 118.

In at least one embodiment, when power cable 110 and control cable 109 are in their respective drawn positions there is less deflection away from riser 103. An increase in the tension of at least one cable 109, 110, can cause movement of the cable retaining member 112 as the cable guard 102 reaches an equilibrium position.

In some embodiments, in a drawn position, a cable 109, 110 is positioned to interfere with the travel path of an arrow's fletching at launch.

In the embodiment shown in FIGS. 1 and 2, the deflection of power cable 110 and control cable 109 towards riser 103 is decreased in their respective drawn positions as compared to the brace positions. In other embodiments, all or some of the cables present may be equally deflected towards the riser in their respective drawn and brace positions.

It should be appreciated that when two or more cables are present, the cable retaining member need only be biased towards a bow riser by one of the cables. Likewise, only one of the cables needs to bias the cable retaining member towards the bowstring plane of travel. In some embodiments the same cable may bias cable the retaining member towards the bowstring plane of travel and the riser. In other embodiments, the cable biasing the cable retaining member towards the riser may change as the bowstring is drawn. The cable biasing the cable retaining member towards the bowstring plane of travel, likewise, may change as the bowstring is drawn.

In some embodiments, the joint 113 comprises a pivoting connection, wherein the cable retaining member 112 can pivot with respect to the body 114 about a pivot axis. A pivot axis can comprise a central longitudinal axis of a pin 405 (see FIG. 4). In some embodiments, the pivot axis is oriented vertically. In some embodiments, the pivot axis is oriented parallel to the bowstring 108 when the bow is an the brace orientation.

In some embodiments, the cable guard 102 comprises one or more rollers or sheaves 116, 117. Each sheave 116, 117 can be arranged to spin about a roller axis. In some embodiments, each sheave 116, 117 is supported by a pin 410 (see FIG. 4). In some embodiments, a central axis of the pin 410 comprises the roller axis. In some embodiments, the roller axis is orthogonal to the pivot axis of the cable retaining member 112.

In some embodiments, the cable guard 102 excludes any biasing members, such as springs, that would function to bias a position of a portion of the cable guard (e.g. the cable retaining member) in any way. Thus, the position of the cable retaining member 112 is dictated by the forces applied by the body 114 and cable(s) 109, 110.

In some embodiments, a cable guard 102 consists of the body 114, joint 113 and cable engaging portion 112, wherein the cable engaging portion 112 may engage the cable(s) 109, 110 in any suitable way (e.g. using sheaves 116, 117, or a sliding contact as could be expected with the embodiment of FIG. 3, or and other suitable engagement).

FIG. 3 shows an embodiment that does not include rollers or sheaves 116, 117. The cable engaging portion 112 comprises a bearing surface 301*a*, 301*b* for each cable 109, 110. In some embodiments, the bearing surface comprises a low friction material, such as a low friction polymer or a ceramic. In some embodiments, a cable engaging portion 112 fully surrounds each cable 109, 110, and the cable engaging portion 112 comprises an aperture 115*a*, 115*b* for each cable 109, 110. In some embodiments, the upper and lower ends of the apertures 115*a*, 115*b* flare, for example to reduce friction with the cable 109, 110. When the cable engaging portion 112 comprises a bearing surface that does not fully surround the cable 109, 110, the upper and lower portions of the bearing surface can comprise curvature, for example to reduce friction with the cable 109, 110.

Figure 4:
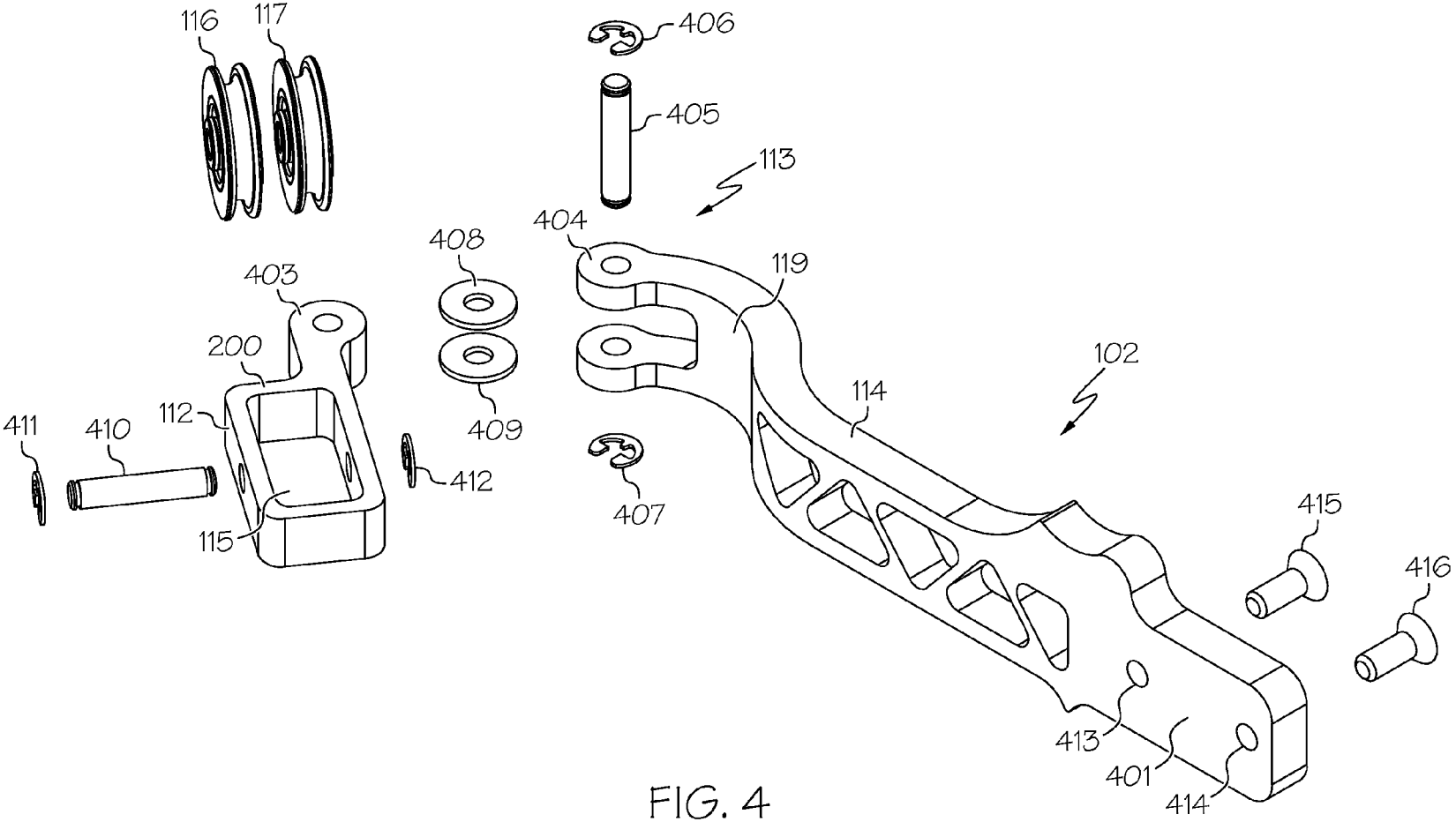
FIG. 4 depicts a detail exploded view of one embodiment of a cable guard comprising sheaves.

FIG. 4 depicts an embodiment of a cable guard 102. FIG. 4 shows a joint 113 connecting the cable retaining member 112 to the body 114 opposite a mounting portion 401. Additionally, joint 113 permits sheaves 116 and 117 to swivel forward, towards mounting portion 401 and body 114. In the embodiment depicted in FIG. 4 the joint 113 is located at the distal end 404 of body 114 and the joint 113 includes the distal end 403 of the cable retaining member 112. As shown in the assembled view, the distal end 403 of cable retaining member 112 is inserted into the distal end 404 of body 114. Body 114 and cable retaining member 112 are then held to together by pin 405 inserted through the distal end 404 of body 114 and the distal end 403 of cable retaining member 112. Pin 405, in turn, is held in place by e-clip retaining rings 406 and 407 or any other suitable fastening arrangement. In one embodiment, to prevent undesirable vertical movement of the distal end 403 of cable retaining member 112, washers 408 and 409 may be incorporated into the joint 113 above and below the distal end 403 of the cable retaining member 112. In some embodiments, washers 408, 409 comprise a low friction material, such as a low friction polymer, to reduce potential frictional forces between the body 114 and cable retaining member 112.

In at least one embodiment, the body 114 has sufficient length dimension to position the joint 113 at least at, or near, the relative location of the power cable 110 and control cable 109 in the drawn position. In combination or the alternative, the length of body 114 may include an enlarged length dimension to place the joint 113 rearward to the drawn position of all of the bow's cables.

In the embodiment depicted in FIG. 4, opening 115 of cable retaining member 112 if the same is utilized, is of sufficient size to receive sheaves 116 and 117, against which two cables of a compound archery bow may be biased in a drawn and/or brace position. In some embodiments, these cables may be two power cables, a power cable and a control cable and/or other combinations of cable and/or bowstrings depending on the type of bow in which it is incorporated. In some embodiments, sheaves 116 and 117 are partially within cable retaining member 112, where a portion of sheave 116 and sheave 117 may extend above, below, or above and below cable retaining member 112. Sheaves 116 and 117 may be held in place by an axle 410 traversing cable retaining member 112, and through sheaves 116 and 117. Axle 410, in turn, may be held in place by e-clip retaining rings 411 and 412 or another suitable type of mechanical fastening device.

In at least one embodiment, the mounting portion 401 is the portion of the cable guard 102 which is secured to the riser 103 of an archery bow 101. Though mounting portion 401 may take on various forms, the mounting portion 401 of at least one embodiment includes holes 413 and 414 which are in turn adapted to receive fasteners 415 and 416 inserted through holes 413 and 414 which are used to secure the cable guard 102 to an archery bow 101.

In combination or the alternative, the mounting portion 401 may include a clamp holding the cable guard 102 onto the riser 103 of an archery bow 101. The mounting portion 401, in combination or the alternative, may comprise a threaded protrusion to be screwed into the riser 103 of an archery bow.

Figure 5:
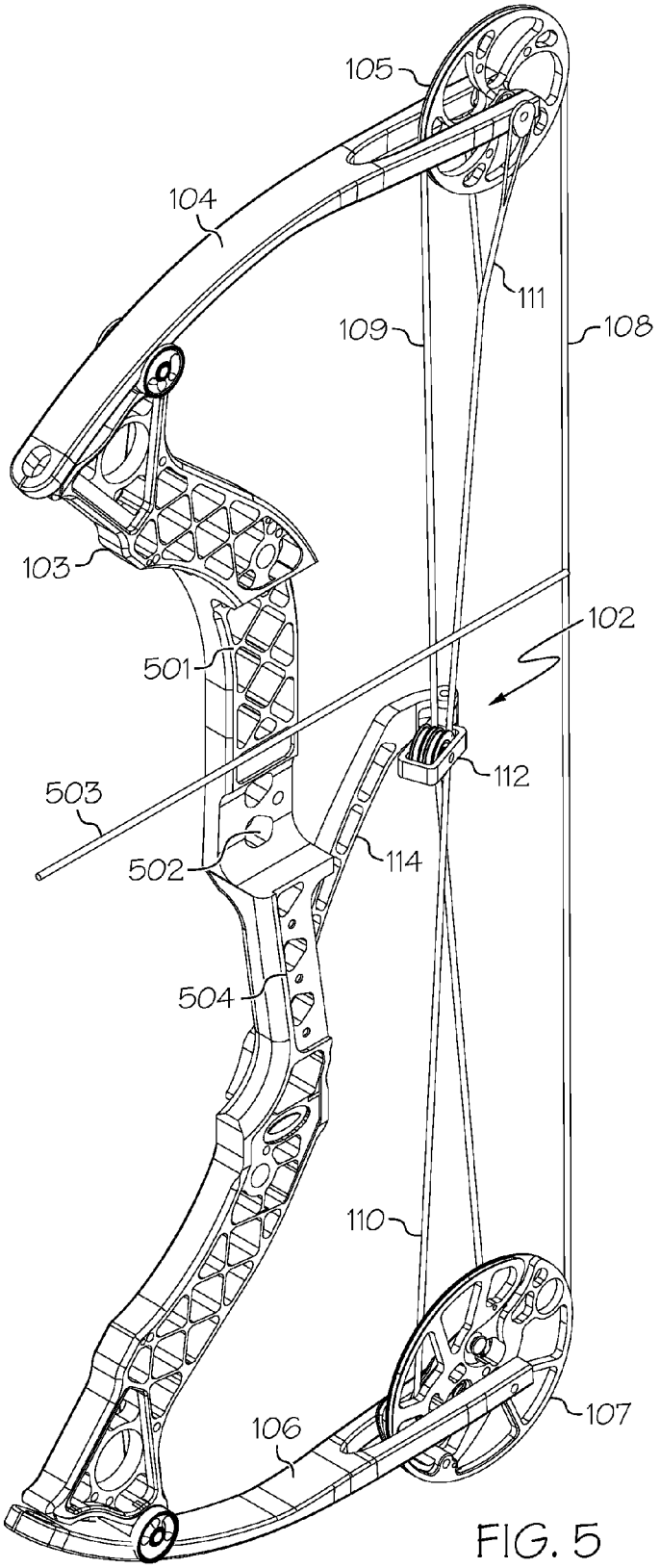
FIG. 5 depicts an isometric view of one embodiment in which the cable guard is mounted to riser below an arrow rest.
Figure 6:
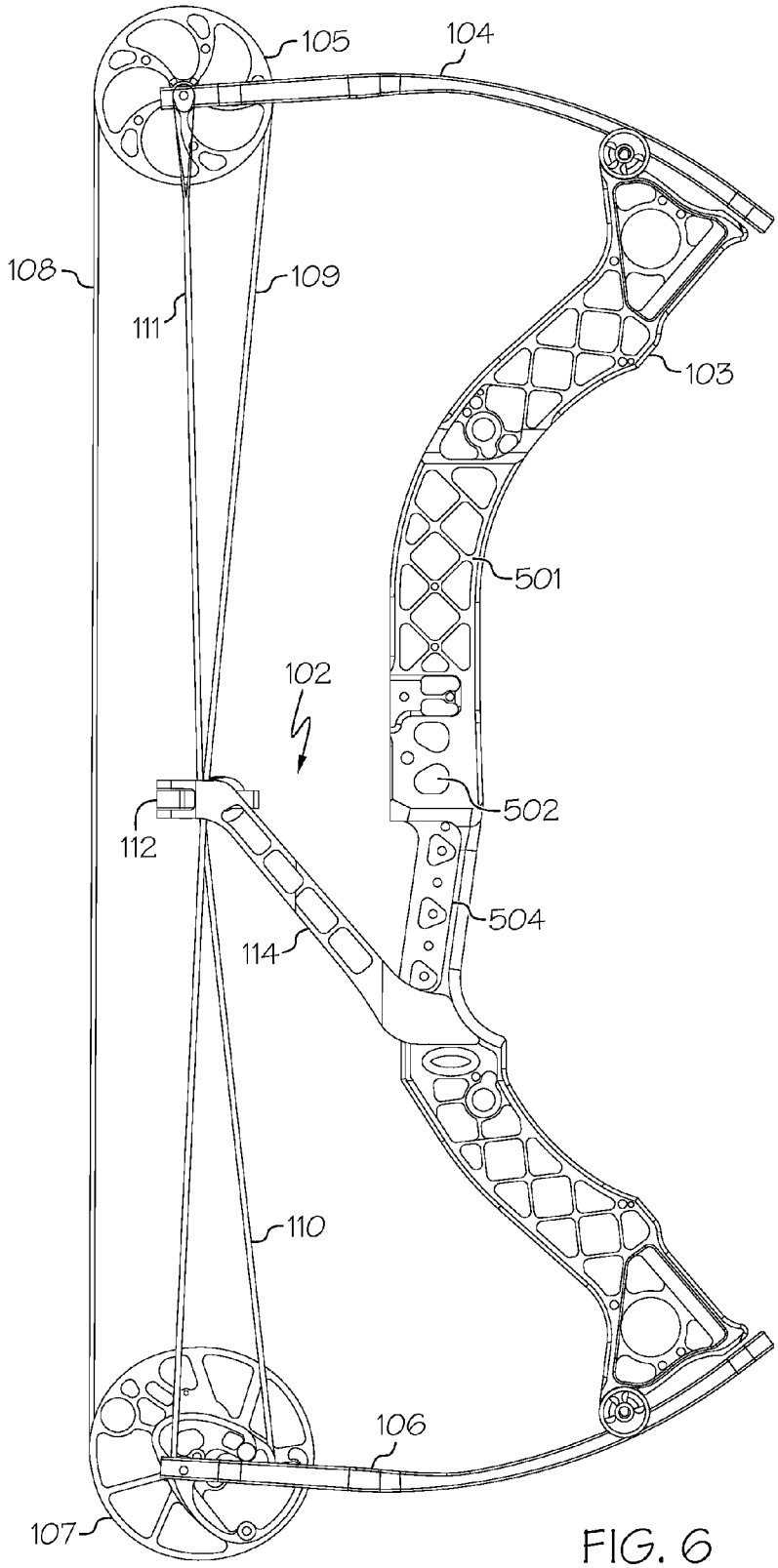
FIG. 6 depicts a side view of the embodiment of FIG. 5.

In at least one embodiment, as shown in FIG. 5, an archery bow 101 incorporating the cable guard 102 may contain a site window 501, or other recess in the riser 103 through which the bow is aimed by the archer. In some embodiments, it is preferable for the cable guard 102 to not visually obstruct the site window 501 during use of the archery bow 101. In some embodiments, the cable guard 102 may be mounted to the riser 103 below the mounting point 502 for an arrow rest, as in the embodiment depicted in FIG. 5.

In some embodiments, as shown in FIG. 5, the mounting cable guard 102 may position the cable retaining member 112 below the flight path of an arrow 503. The embodiment of cable guard 102 depicted in FIG. 5 may be mounted to riser 103 below a handle 504. Body 114 may be attached to mounting portion 401 at an angle of less than 180 degrees. Body 114 of cable guard 102, consequently, may project upward and back from riser 103, positioning joint 113 behind the drawn position of power cable 110.

In other embodiments, cable retaining member 112 may move out of a bow's sight window as the bow is drawn. In some embodiments, drawing a bowstring 108 may position the opening 115 of the cable retaining member 112 closer to the bowstring plane of travel when the respective bowstring is drawn. This movement may reduce the deflection of any power cable 110 or control cable 109 away from the bowstring plane of travel. Movement of the cable retaining member 112 may include a component that is parallel to the bow's bowstring plane of travel and substantially orthogonal to the brace position of the bowstring. Movement parallel to the bowstrings plane of travel permits the cable retaining member 112 to move rearward, away from the bow's riser 103 as the bowstring is drawn. This movement permits the cable retaining member 112 to follow the lateral displacement of at least one retrained cable to its drawn position.

In at least one embodiment, the joint 113 defines a vertically oriented, pivotal axis of rotation, which may be parallel, or substantially parallel, to the bowstring plane of travel. The pivotal axis of rotation in at least one embodiment is in a fixed location with respect to the riser 103. In at least one embodiment the pivotal axis of rotation is disposed rearwardly with respect to the riser 103. The pivotal axis of rotation may also be in a fixed relative location rearwardly with respect to the power cable 110 or control cable 109, and forwardly relative to the bowstring 108, when the bowstring 108 is in the brace position. In at least one embodiment, as the bowstring 108 is drawn, the cable retaining member 112 will rotate about the pivotal axis of rotation of the joint 113 as earlier described relative to arc 118. In some embodiments, when the bowstring 108 is in the drawn position, the power cable 110 or control cable 109 will have moved rearwardly about the fixed location for the pivotal axis of rotation, increasing a distance between the either cable 109, 110 and the riser 103.

In at least one embodiment, the pivotal axis of rotation is also in a fixed location laterally with respect to the bowstring plane of travel. During draw of the bowstring 108, the cable retaining member 112 will rotate about the fixed pivotal axis of rotation to reposition the power cable 110 and control cable 109 proximate to the bowstring of travel. During draw of the bowstring 108 the pivotal axis of rotation will remain fixed relative to the riser 103 and the bowstring plane of travel.

In at least one embodiment the cable guard 102 as disclosed and as depicted herein may be modified for either left or right handed archers, where the features as depicted and described may be reversed or mirror images relative to each to, accommodate a bow set up as desired by an individual.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims may be combined with each other in other manners within the scope of the invention such that the invention should be recognized as also specifically directed to other embodiments having any other possible combination of the features of the dependent claims.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A compound archery bow comprising:
- a riser;
- a first limb supporting a first rotatable member, the first rotatable member comprising a first bowstring track;
- a second limb supporting a second rotatable member, the second rotatable member comprising a second bowstring track and a cam assembly;
- a bowstring extending between the first bowstring track and the second bowstring track, the bowstring defining a bowstring plane of travel;
- a cable in communication with the cam, the cable having a brace position and a drawn position; and
- a cable guard comprising:
  - a body attached to the riser;
  - a cable retaining member; and
  - a joint connecting the cable retaining member to the body, the joint defining a pivot axis, wherein said pivot axis is disposed at a fixed location relative to said riser and wherein the joint is constructed and arranged to provide pivotal movement of the cable retaining member relative to the body about the pivot axis, towards and away from the bowstring plane of travel.

2. The compound archery bow of claim 1, wherein said pivot axis is oriented parallel to the bowstring when the bowstring is in a brace position.

3. The compound archery bow of claim 1, said body comprising a recess between the joint and the riser.

4. The compound archery bow of claim 1, said cable retaining member comprising an opening, said cable disposed within said opening.

5. The compound archery bow of claim 1, said cable retaining member comprising a sheave.

6. The compound archery bow of claim 1, said joint comprising a pin connecting the body to the cable retaining member.

7. The compound archery bow of claim 1 wherein said pivot axis is parallel to said bowstring plane of travel.

8. The compound archery bow of claim 1, wherein said pivot axis is disposed in a fixed location rearwardly with respect to the cable and forwardly relative to the bowstring.

9. The compound archery bow of claim 1, the bowstring having a brace position and a drawn position, wherein the cable retaining member rotates about the pivot axis during draw of the bowstring to the drawn position.

10. The compound archery bow of claim 1, wherein said cable retaining member moves along an arc, and said arc is substantially perpendicular to the bowstring plane of travel.

11. The compound archery bow of claim 1, wherein said cable moves rearwardly toward said pivotal axis of rotation during draw of the bowstring to the drawn position.

12. The compound archery bow of claim 1, wherein said pivotal axis of rotation is in a fixed lateral location with respect to the bowstring plane of travel.

13. The compound archery bow of claim 1, wherein said cable guard is constructed for a right handed bow or a left handed bow.

14. A compound archery bow comprising:
- a riser;
- a first limb supporting a first rotatable member, the first rotatable member comprising a first bowstring track;
- a second limb supporting a second rotatable member, the second rotatable member comprising a second bowstring track and a cam assembly;
- a bowstring extending between the first bowstring track and the second bowstring track, the bowstring defining a bowstring plane of travel;
- a cable in communication with the cam, the cable having a brace position and a drawn position; and
- a cable guard comprising:
  - a body attached to the riser;
  - a cable retaining member; and
  - a joint connecting the cable retaining member to the body, the joint defining a pivot axis, the cable retaining member pivotable with respect to the body about the pivot axis; a position of said pivot axis being fixed with respect to the riser and located rearward of said cable, said pivot axis being parallel to said bowstring plane of travel.

15. The compound archery bow of claim 5, wherein said cable retaining member comprises a frame that surrounds said sheave.

16. A compound archery bow comprising:
- a riser;
- a first limb supporting a first rotatable member, the first rotatable member comprising a first bowstring track;

a second limb supporting a second rotatable member, the second rotatable member comprising a second bowstring track and a cam assembly;

a bowstring extending between the first bowstring track and the second bowstring track, a portion of said bowstring defining a straight axis when said archery bow is in a brace orientation;

a cable in communication with the cam; and a cable guard comprising:

a body, said body fixedly attached to the riser;

a cable retaining member arranged to bias said cable; and a joint connecting the cable retaining member to the body, the joint defining a pivot axis, the cable retaining member pivotable with respect to the body about the pivot axis, said pivot axis being substantially parallel to said straight axis.

17. The compound archery bow of claim 16, wherein cable retaining member comprises a frame that surrounds said cable.

18. The compound archery bow of claim 16, wherein cable retaining member comprises a roller.

19. The compound archery bow of claim 16, wherein said riser comprises a grip and said frame is attached to said riser at a location below said grip.

* * * * *